United States Patent [19]

Eckerud

[11] Patent Number: 4,977,648

[45] Date of Patent: Dec. 18, 1990

[54] DEVICE AT A SNAP-IN LOCK

[75] Inventor: Ove Eckerud, Linköping, Sweden

[73] Assignee: Conforex AB, Linkoping, Sweden

[21] Appl. No.: 435,412

[22] PCT Filed: May 4, 1988

[86] PCT No.: PCT/SE88/00225

§ 371 Date: Oct. 31, 1989

§ 102(e) Date: Oct. 31, 1989

[87] PCT Pub. No.: WO88/08914

PCT Pub. Date: Nov. 17, 1988

[51] Int. Cl.[5] ..... A44B 17/00

[52] U.S. Cl. ..... 24/573.1; 24/587; 24/671

[58] Field of Search ..... 292/DIG. 38; 24/587, 24/573, 662, 671, 673, 627

[56] References Cited

U.S. PATENT DOCUMENTS

| | | | |
|---|---|---|---|
| 464,884 | 12/1891 | Liming | 24/671 X |
| 620,761 | 3/1899 | Fassett . | |
| 2,530,031 | 11/1950 | Rudolph | 24/627 X |
| 3,191,727 | 6/1965 | Schmeltz et al. | 24/587 X |
| 3,309,096 | 3/1967 | Inka | 24/573 X |
| 3,460,282 | 8/1969 | Swirsky | 24/573 X |
| 4,158,244 | 6/1979 | Stefan | 24/587 X |
| 4,509,232 | 4/1985 | Kanzaka | 24/662 X |

FOREIGN PATENT DOCUMENTS

| | | |
|---|---|---|
| 421484 | 12/1981 | Sweden . |
| 139138 | 6/1930 | Switzerland . |

*Primary Examiner*—James R. Brittain

*Attorney, Agent, or Firm*—Jeffers, Hoffman & Niewyk

[57] ABSTRACT

An arrangement for a snap lock includes a first component having a projecting part that is capable of being introduced into a corresponding cavity in a second component. An indentation in the projecting part is oriented transverse to the direction of introduction into the cavity. A snap device, e.g., a piece of profile strip made of flexible material such as plastic or rubber, is introduced into an undercut groove in the wall of the cavity, wherein a portion of the strip corresponding to the indentation extends into the cavity, thereby producing a snap locking function between the components when introduced one into the other. The components are preferably formed of pieces cut to identical lengths from two extruded profile strips made of rigid material, such as plastic or light metal.

6 Claims, 2 Drawing Sheets

DEVICE AT A SNAP-IN LOCK

BACKGROUND OF THE INVENTION

The present invention relates to an arrangement for a snap lock comprising a first component, which has a projecting part, which is capable of being introduced into a corresponding cavity in a second component, in conjunction with which there is present in the aforementioned component, or alternatively in the wall of the cavity, at least one indentation arranged across the direction of introduction, into which a snap device arranged in the wall of the cavity, or alternatively on the projection, is so arranged as to snap into engagement on being introduced, for the purpose of producing a locking function.

There is already available on the market a large number of different embodiments of snap locks, which, although they function satisfactorily and are of at least seemingly simple construction, nevertheless consist of a number of mechanically interacting components. These usually consist of springs, or contain spring components to produce the snap effect, which means, amongst other things, that the hardness of the snap effect cannot be varied without significant intervention in the snap lock, or can only be varied by changing to another snap lock with increased or reduced hardness in the snap effect.

SUMMARY OF THE INVENTION

A primary object of the present invention is to make available a snap lock of the kind referred to by way of introduction, which is of simple construction, especially with regard to the snap device, the hardness of which can easily be given an appropriate value. This is achieved in accordance with the invention by the first and second components of the snap lock consisting of pieces of two extruded profile strips made of a rigid material such as plastic or light metal and cut preferably to identical length, in conjunction with which the aforementioned snap device is in the form of a piece of profile strip made of a flexible material such as plastic or rubber introduced into an undercut groove which extends all the way through the profile, which profile strip exhibits a cross-section such that it is capable of being introduced into, and is thus capable of being fixed in the undercut groove, which, thanks to its undercut profile, follows the external form of the profile strip over more than half its circumference.

As will be appreciated from one particular characteristic feature of the invention, the profile strip which forms the snap device can be a piece of hose, the wall thickness of which is selected so as to achieve appropriate hardness in the snap effect.

It is clear from other particular characteristic features of the invention that the snap lock can be double-acting by providing the aforementioned first component with two diametrically opposing projecting parts, each of which is capable of being introduced into its own cavity in components of the same kind as the aforementioned second component, in addition to which special decorative effects can be produced by the aforementioned first component comprising a piece of tubular profile moulding of circular, square or rectangular cross-section arranged between the projecting parts.

BRIEF DESCRIPTION OF THE DRAWINGS

The invention is explained in more detail below with reference to the accompanying drawing, in which.

DESCRIPTION OF THE PREFERRED EMBODIMENT

Figure 1:
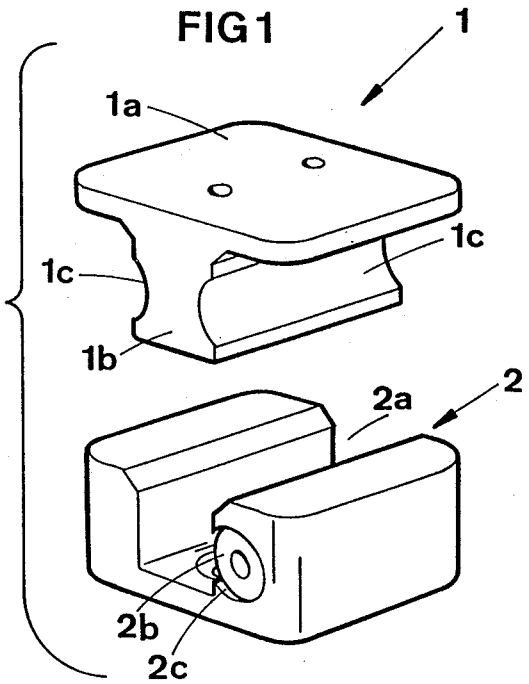
FIG. 1 illustrates in perspective view an embodiment of a snap lock in accordance with the invention.

The embodiment of a snap lock in accordance with the invention illustrated in FIG. 1 comprises a male component 1 and a female component 2. The male component 1 consists of a mounting plate 1*a* with a projecting part 1*b* which is capable of being introduced into a correspondingly formed cavity 2*a* in the female component 2. The projecting part 1*b* is executed with two indentations 1*c* arranged to either side of same. A snap device 2*b*, which is arranged in the cavity wall, is so arranged as to snap into engagement in at least one of these indentations, for the purpose of producing a locking function, when the projection 1*b* is introduced into the cavity 2*a*. The presence of two opposing indentations 1*c* means that the male component 1 does not need to be turned in relation to the snap device 2*b*.

In accordance with the invention the snap device 2*b* is a piece of profile strip made of a flexible material such as plastic or rubber introduced into an undercut groove 2*c* in the cavity wall. In the embodiment illustrated in FIG. 1 the profile strip 2*b* is a piece of a hose, which has been pushed into the groove 2*c* from the side, although it is obvious that the profile strip can also exhibit triangular cross-section, for example, in which case the undercut groove is also given a corresponding form.

The snap device in accordance with FIG. 1 is cable of being used, in appropriate dimensions, for wardrobe doors and cupboard doors, but can also be used with more robust dimensioning for the separable fastening of, for example, wall and floor elements making up an exhibition stand, which clearly must be capable of being assembled rapidly as required, and of being dismantled equally rapidly.

Figure 2A:
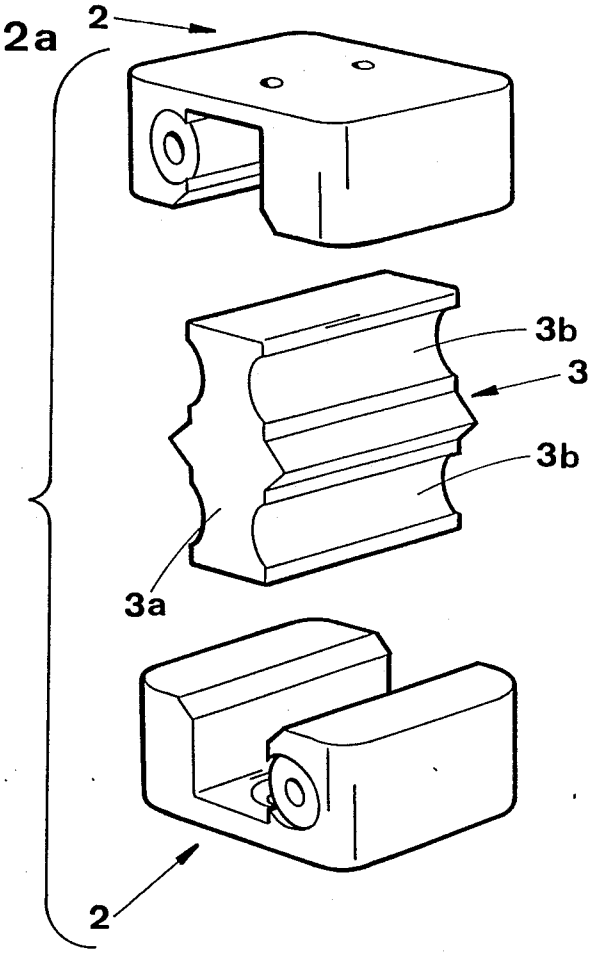
FIGS. 2*a* and 2*b* illustrate in perspective view two different embodiments of double-acting snap locks in accordance with the invention.
Figure 2B:
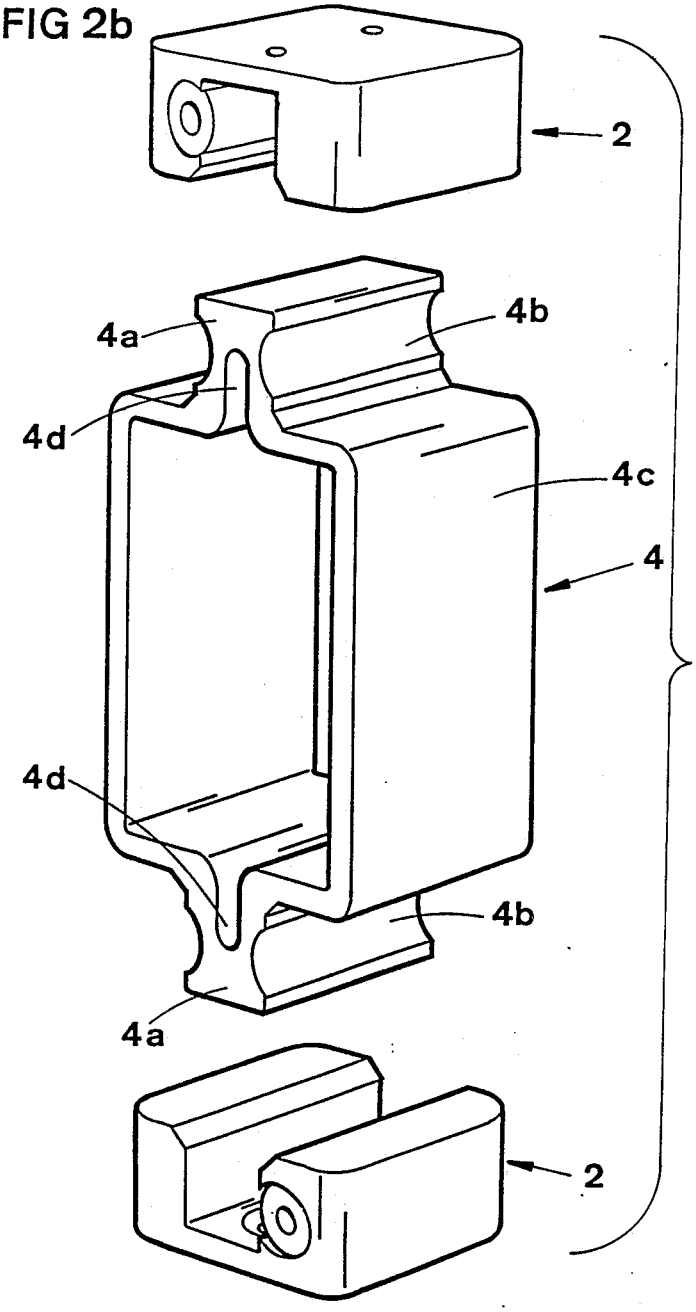

The snap lock in accordance with FIGS. 2*a* and 2*b* is intended primarily for the connection of wall and floor elements for an exhibition stand, in which case the embodiment in accordance with FIG. 2*a* permits invisible fastening, and the use of the embodiment in accordance with FIG. 2*b* enables special decorative effects to be achieved, details of which are given below. The snap lock in accordance with FIG. 2*a*, 2*b* contains two female components of the same kind as the female component 2 described in conjunction with FIG. 1. The male component 3 in accordance with FIG. 2*a* has two diametrically opposing projecting parts 3*a* with indentations 3*b*, that is to say it is essentially identical with the projecting part 1*b*. The same is true of the male component 4 in the embodiment in accordance with FIG. 2*b*, although in this case a tubular profile moulding 4*c* is arranged between the projecting parts 4*a* with their respective indentations 4*b*, which tubular profile moulding exhibits rectangular cross-section in the embodiment illustrated in the drawing, but can also exhibit circular, square or oval cross-section. The tubular profile moulding 4*c* serves as a distance piece for the connection of two wall elements, whereby a special optical effect is achieved. This effect can be further increased by the introduction of a decorative strip element 5 into the profile moulding in the male component of several interacting snap locks, as indicated by a broken line in FIG. 2*b*, the edges of which decorative strip element run in slots 4*d* in the tubular profile moulding 4*c*.

It is obvious that the invention cannot be regarded as being restricted to the embodiments described above and illustrated in the drawing, but may be modified in many ways within the scope of the idea of invention. Thus, for example, the indentations can be arranged as an alternative in the cavity wall, and the projecting part of the male component can be executed with snap devices. As mentioned by way of introduction, the profile strip 2*b* can also exhibit triangular, square or oval cross-section, for example, in which case the undercut groove 2*c* and possibly also the indentations 1*c* are given a corresponding form.

What is claimed is:

1. An arrangement for a snap lock, comprising:

a first component including a projecting part;

a second component including a cavity corresponding to said projecting part into which said projecting part is capable of being introduced;

at least one indentation defined in one of the projecting part and the cavity, said indentation being arranged across the direction of introduction of said second component into said first component; and a snap device associated with the other of the projecting part and the cavity, said snap device being adapted to snap into engagement with said indentation upon introduction of said second component into said first component, thereby producing a locking function therebetween;

wherein said first and second components comprise respective pieces of extruded profile strips of rigid material cut to substantially equal lengths, and said snap device comprises a piece of profile strip of a flexible material, said snap device further comprising an undercut groove extending through said component associated with said other of the projecting part and the cavity and having an opening, said profile strip of said snap device exhibiting a cross-sectional shape such that upon introduction into said undercut groove said profile strip of said snap device substantially occupies said undercut groove and is retained therein, said undercut groove having an undercut profile that follows the external form of the profile strip of said snap device along more than half of its circumference, the remaining portion of its circumference extending out of said opening and being yieldable during introduction of said second component into said first component and thereafter substantially filling said indentation.

2. The arrangement of claim 1 in which said first component has two diametrically opposed projecting parts, each of which is capable of being introduced into a corresponding cavity in a respective said second component.

3. The arrangement of claim 2 in which said first component comprises a piece of tubular profile moulding arranged between the projecting parts.

4. The arrangement of claim 1 in which said profile strip of said snap device is in the form of a hose, the wall thickness of which is selected so as to achieve appropriate hardness in the snap effect.

5. The arrangement of claim 4 in which said first component has two diametrically opposed projecting parts, each of which is capable of being introduced into a corresponding cavity in a respective said second component.

6. The arrangement of claim 4 in which said first component comprises a piece of tubular profile moulding arranged between the projecting parts.

* * * * *